United States Patent [19]

Wiggins

[11] 4,196,238

[45] Apr. 1, 1980

[54] STRAND COVERED DECORATIVE ORNAMENT WITH PRINTED DESIGN

[75] Inventor: Anne L. Wiggins, Belmont, N.C.

[73] Assignee: Rauch Industries, Inc., Gastonia, N.C.

[21] Appl. No.: 658,774

[22] Filed: Feb. 17, 1976

[51] Int. Cl.[2] ..... A47G 33/08

[52] U.S. Cl. ..... 428/11; 428/187; 428/371

[58] Field of Search ..... 428/11–35, 428/187, 195–198, 7–12, 371; 101/35–41

[56] References Cited

U.S. PATENT DOCUMENTS

| | | | |
|---|---|---|---|
| 1,666,099 | 4/1928 | Kingman | 428/11 |
| 3,132,988 | 5/1964 | Fowler | 428/11 |
| 3,533,890 | 10/1970 | Nesbit | 428/11 |
| 3,565,735 | 2/1971 | Burnbaum | 428/11 |
| 3,802,946 | 4/1974 | Chase | 428/11 |
| 3,863,564 | 2/1975 | Higuchi | 101/35 |
| 3,868,899 | 3/1975 | Nye et al. | 101/35 |
| 3,946,664 | 3/1976 | Peckinpaugh et al. | 101/41 |

*Primary Examiner*—Henry F. Epstein

*Attorney, Agent, or Firm*—Bell, Seltzer, Park & Gibson

[57] ABSTRACT

A decorative ornament is provided which includes strand material spirally wound in individual, side-by-side windings about the smooth exterior surface of a three dimensional core and one or more printed contrasting designs on and spanning a substantial number of the windings of strand material to stabilize the windings on the core while also providing additional decorative ornamentation for the ornament.

7 Claims, 4 Drawing Figures

STRAND COVERED DECORATIVE ORNAMENT WITH PRINTED DESIGN

This invention relates to decorative ornaments and more particularly to improved ornaments of the type having a wound strand covering thereon.

Decorative ornaments of the type having a three dimensional core, usually of molded polystyrene material, having a smooth outer surface covered by high sheen strand material spirally wound about the core are known and provide exceptional decorative quality and many advantages. Ornaments of this type are disclosed and claimed in U.S. Pat. No. 3,132,988 issued to Wade F. Fowler on May 12, 1964 and assigned to the same assignee as this application.

While the advantages of the strand covered ornaments far out weigh the difficulties, such difficulties have been encountered and include a tendency for the individual windings of strand material to shift relative to the smooth surface of the core and thereby become loosened or frayed. Loosening or fraying of the strand material greatly decreases the decorative quality of the ornament and may even destroy its usefulness completely. In addition, while numerous designs employing solid color and multi-colored strand material have been used, the designs which have heretofore been available with ornaments of this type have been limited.

It is therefore the object of the present invention to provide an improved ornament of the type having a wound strand covering in which the aforementioned difficulties are overcome by providing virtually unlimited design possibilities and by stabilizing a substantial number of the individual windings.

The foregoing object of this invention is accomplished by providing at least one printed design on, and constrasting with, the wound strand covering of the ornament which spans a substantial number of the individual strand windings to stabilize those windings on the core as well as providing additional decorative ornamentation for the ornament.

Additional objects and features of this invention will become apparent from the following detailed description and examples of illustrative embodiments of the invention, and from the accompanying drawings, in which FIG. 1 is a front elevation of a spheroidal shaped ornament incorporating the features of the present invention;

Figure 1:
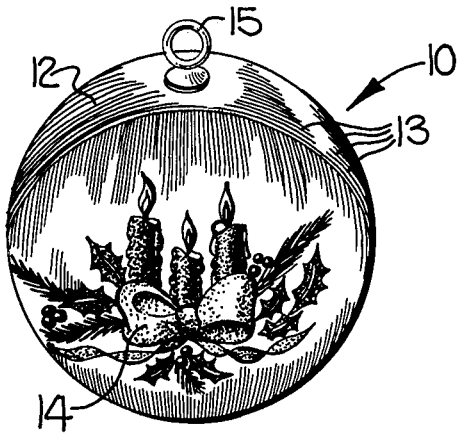
Figure 2:
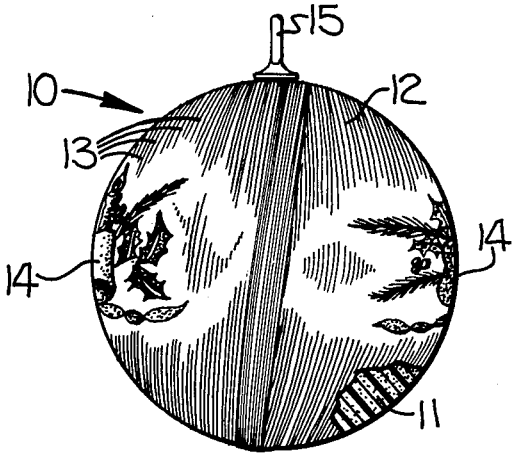
FIG. 2 is a side elevation of the ornament shown in FIG. 1.
Figure 3:
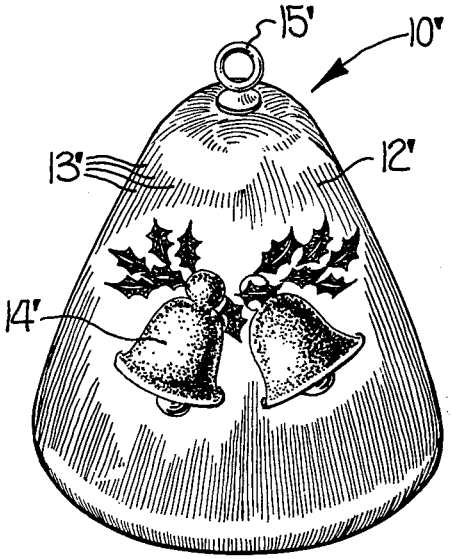
FIG. 3 is a front elevation of a paraboloidal shaped ornament incorporating the features of this invention.
Figure 4:
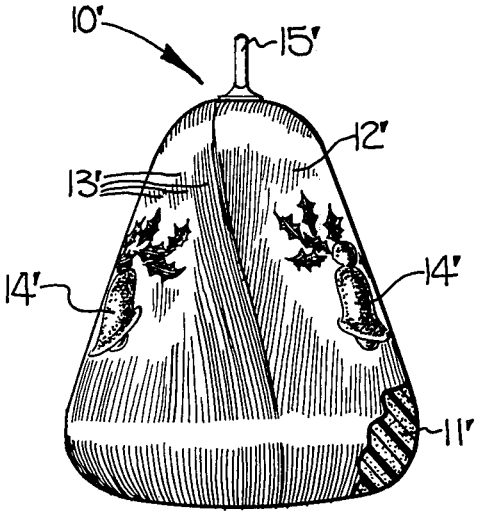
FIG. 4 is a side elevation of the ornament shown in FIG. 3.

Referring now more specifically to the drawings, decorative ornaments incorporating the features of the present invention are generally indicated at 10 and 10'. Ornaments 10 and 10' each include a core 11, 11' having a relatively smooth outer surface. The cores 11, 11' may be of any suitable material, but preferably are of lightweight plastic material, such as molded polystyrene. Additionally cores 11, 11' may be of any desired shape that is capable of having strand material wound thereabout. It is preferred by this invention that those shapes having double curved surfaces be used and examples of such shapes are spheroids (FIGS. 1 and 2), paraboloids (FIGS. 3 and 4), ellipsoids, ovoids, etc.

The cores 11, 11' each have an outer covering 12 or 12' of strand material, such as rayon acetate yarn or textured polyester yarn, spirally wound about the smooth outer surface of core 11 or 11' in individual windings 13 or 13' disposed in side-by-side relationship. Reference is made to the aforementioned U.S. Pat. No. 3,132,988 for a more detailed showing and description of the manner of making ornaments of this type.

Ornament 10 or 10' further includes printed designs 14 or 14' applied to the outer surface of the outer covering 12 or 12' and spanning a substantial number of the individual windings 13 or 13'. Preferably, the printed designs 14 or 14' span at least approximately one-half of the circumference of core 11 or 11'. As illustrated, designs 14 or 14' are located at generally diametrically opposed areas of core 11 or 11'.

Additionally, designs 14 or 14' may be of one color or a plurality of colors and may be of any desired subject matter commensurate with the purpose of the ornament 10 or 10'. The ornaments 10 and 10' illustrated are intended for use as decorations for Christmas trees and the designs 14, 14' were selected to reflect that theme.

Preferably, designs 14, 14' are printed directly onto the outer surface of coverings 12, 12' and are formed by coloring materials or inks having the capacity when dry to stabilize at least a substantial number of the individual windings 13, 13' spanned by the designs 14, 14' to assist in preventing those windings from becoming loosened or frayed. An example of inks having this capability are the half-tone colored, screen printing inks, such as those made and sold by Sinclair and Valentine Ink Company of Kansas City, Mo.

Hangers 15, 15' are attached to cores 11, 11' respectively, by having portions thereof inserted in holes (not shown) in the respective cores 11, 11' and complete the ornaments 10, 10' and make them ready for hanging as decorations, such as on a Christmas tree.

In the drawings and specification, there has been set forth a preferred embodiment of the invention, and although specific terms are employed, they are used in a generic and descriptive sense only and not for purposes of limitation.

That which is claimed is:

1. A decorative ornament comprising a three dimensional core having a smooth outer surface, strand material being spirally wound about the smooth exterior surface of said core in individual windings disposed in side-by-side relationship and providing a smooth outer covering for said core, and at least one printed design on and contrasting with said outer covering of said core, said printed design spanning a substantial number of said individual windings of strand material and serving to stabilize said windings on said core to assist in preventing fraying, separation or loosening of the windings as well as providing additional decorative ornamentation for the ornament.

2. A decorative ornament according to claim 1 wherein printed designs are provided on said outer covering at two spaced apart areas on said core.

3. A decorative ornament according to claim 1 wherein said printed design is of at least one color different from the color of said strand material.

4. A decorative ornament comprising a three dimensional core having a smooth outer surface, strand material being spirally wound about the smooth exterior surface of said core in individual windings disposed in side-by-side relationship and providing a smooth outer covering for said core, and printed designs on said outer covering of said core at two spaced apart, opposed areas and being of at least one color different from the color of said strand material, said printed designs spanning a substantial number of said individual windings of strand material at each of said areas and serving to stabilize said windings on said core to assist in preventing fraying, separation or loosening of the windings as well as providing additinal decorative ornamentation for the ornament.

5. A decorative ornament according to claim 4 wherein said core is of a three dimentional shape having a double curved surface and said printed designs are on diametrically opposed areas of said core.

6. A decorative ornament according to claim 5 wherein said printed designs span at least approximately one-half of the circumference of said core.

7. A decorative ornament comprising a three dimensional core having a double curved, smooth outer surface, strand material being spirally wound about the smooth exterior surface of said core in individual windings disposed in side-by-side relationship and providing a smooth outer covering for said core, and multi-colored printed designs on said outer covering of said core at diametrically opposed, spaced apart areas, said printed design spanning at least approximately one-half of the circumference of said core and serving to stabilize said windings on said core to assist in preventing fraying, separation or loosening of the windings as well as providing additional decorative ornamentation for the ornament.

* * * * *